United States Patent [19]

Ogino et al.

[11] Patent Number: 4,580,521

[45] Date of Patent: Apr. 8, 1986

[54] RELEASE AGENT APPLICATOR FOR USE WITH COPYING MACHINE

[75] Inventors: Takao Ogino; Hiroo Katsuya; Chiaki Kato; Itsuro Kato; Tsutomu Kato, all of Osaka, Japan

[73] Assignees: Sumitomo Electric Industries, Ltd.; Sharp Kabushiki Kaisha, both of Osaka, Japan

[21] Appl. No.: 610,748

[22] Filed: May 16, 1984

[30] Foreign Application Priority Data

May 19, 1983 [JP] Japan ..... 58-88941
May 19, 1983 [JP] Japan ..... 58-88943
May 19, 1983 [JP] Japan ..... 58-88945

[51] Int. Cl.[4] ..... B05C 11/105

[52] U.S. Cl. ..... 118/60; 118/260; 118/264; 432/60

[58] Field of Search ..... 118/60, 260, 264, 101, 118/70; 355/3 FU; 219/216; 432/60

[56] References Cited

U.S. PATENT DOCUMENTS 4,375,201 3/1983 Kato ..... 118/101 X
4,458,625 7/1984 Sakane et al. ..... 118/60

FOREIGN PATENT DOCUMENTS 1324179 3/1963 France ..... 118/264

*Primary Examiner*—John P. McIntosh
*Attorney, Agent, or Firm*—Staas & Halsey

[57] ABSTRACT

A release agent applicator for use with a copying machine providing even application of the release agent to a fixing roll of a plain paper copying machine with little leakage of the release agent. A porous polyethylene tetrafluoride resin tube is accommodated in a divided-type support composed of two members which, when joined together, form a longitudinally extending opening having a width smaller than the maximum width of a cavity formed inside the support. The major portion of the outer surface of the porous resin tube is in contact with abutting walls of the cavity to be sealed thereby, and the remaining portion of the tube surface extends outwardly through the support opening to provide a release agent outlet. Both the porous tube and the support may be provided with air inlets having the diameter greater than the diameters of the pores in the porous tube to introduce air into the interior of the porous tube. Further, the porous tube may be initially covered with a film of a polymer having a low melting point. When the applicator is used for the first time, the normal heating of the fixing roll melts the polymer and readies the tube for use.

8 Claims, 14 Drawing Figures

RELEASE AGENT APPLICATOR FOR USE WITH COPYING MACHINE

BACKGROUND OF THE INVENTION

The present invention relates to an apparatus for applying a release agent, such as silicone oil, to the fixing roll of a plain paper copying (PPC) machine.

In the conventional fixing mechanism for a PPC machine, the toner pattern transfered to copy paper is fixed to the copy paper by passing the copy paper between a heated fixing roll and a elastic pressure roll such as a rubber roll. Unfortunately, while the paper with the toner pattern is passing between the heated fixing roll and the elastic pressure roll, the paper has a tendency to stick to both of the two rolls, causing various problems such as imcomplete fixing, a double image due to the adherence of toner particles to the fixing roll rather than the copy paper (this phenomenon is generally referred to as "offsetting"), and malfunction of the copying machine.

While various methods have been proposed for solving these problems, the most usual method is to apply a release agent to the fixing roll and elastic roll. However, applying a uniform coating of the release agent in the correct amount is very difficult. If the amount of the release agent is excessive, the paper may be stained. Furthermore, too rapid a consumption of the release agent requires frequent application of the agent, and if excessive amounts of the agent are present, it will solidify on the roll surface and cause problems with the copying process. If the amount of the release agent is too small, offsetting will unavoidably occur, or the resulting poor releasability from the roll surface will cause the paper to stick to the roll. Commonly used relese agents are heat-resistant oils such as silicone oil.

To eliminate these defects, various release agent applicators have been proposed, but none has proved to be completely satisfactory.

One of the inventors previously invented a release agent applicator. The applicator of the invention assures uniform application of the release agent, requires a minimum consumption of the agent, and can be installed in a very small area. Furthermore, the applicator has a simple configuration, is very inexpensive, and can be thrown away after use.

As shown in FIGS. 1A and 1B and 2, the fixing appartus of that invention basically consists of a fixing roll 14 and a pressure roll 15, between which the toner image is passed to be fused onto a copy paper 16. This apparatus is characterized in that a porous polyethylene tetrafluoride resin tube 7 having both ends closed is brought into contact with the fixing roll 14 in its axial direction. A release agent 6 contained in that porous resin tube oozes out through pores of the tube to apply a thin coating of the release agent onto the roll.

Since the porous tube 7 is soft, it is carried on a support 1 (FIGS. 1A and 1B) or 4 (FIG. 2). All pores of the porous tube except those in the area which acts as an outlet for the release agent are closed with fluorine rubber or another suitable material. This is done for the purpose of discharging a predetermined and uniform amount of the release agent. The porous tube 7 may be filled with the releasable agent 6 before the tube is nested in the support. The applicator used for the filling operation can be thrown away after use. Alternatively, the tube may be filled with the release agent through an inlet 5 after the tube is accommodated in the support.

In FIGS. 1A and 1B and 2, reference numeral 2 represents the area of the porous polyethylene tetrafluoride resin tube where the pores are closed, 3 refers to that area of the porous polyethylene tetrafluoride resin tube where the pores are left open, and 5 indicates an inlet for introducing the release agent.

However, this apparatus is still defective in that a significant amount of time is required to close the pores in the area of the porous tube other than that through which the release agent is to ooze out.

SUMMARY OF THE INVENTION

The present invention provides a simpler way to close the pores in the area of the porous tube other than the outlet of the release agent. According to the present invention, the pores in the area of a porous polyethylene tetrafluoride resin tube other than that through which a release agent oozes out are closed by contact with a support. In order to achieve this result, the support provided is of a divided type, with the porous tube being held between its two members. The support has a cross section such that the width of an opening from which the area of the porous tube providing an outlet for the release agent projects is smaller than the maximum width of a cavity for accommodating the porous tube.

The assembly of the two support members is used to close the pores in the areas of the porous tube other than that area through which the release agent oozes out. The porous tube may be filled with the release agent either before or after assembly with the support members.

Further in accordance with the invention, to improve the uniformity of the amount of release agent applied, both the porous polyethylene tetrafluoride resin tube and the support can be provided with an air inlet having a diameter greater than that of the pores in the porous tube so that air can be introduced into the interior of the porous tube. The air inlet is positioned opposite the side of the support from which the porous tube projects. This construction ensures a minimum change with time in the amount of the release agent being applied.

Further, the air inlet in the porous tube may be staggered in position with respect to the air inlet in the support. This arrangement prevents the release agent in the tube from spilling out of the applicator due to thermal expansion which occurs when the applicator is installed on the fixing roll.

In accordance with another embodiment of the invention, the outer surface of that part of the porous tube which projects from the opening in the support is covered in the middle portion thereof in the widthwise direction with a film of a polymer having a low melting point, such as polyethylene, and both ends of the middle portion are inserted between the wall of the cavity in the support and the porous tube. The two extreme ends of the polymer film in its widthwise direction are inserted between the mating surfaces of the support members, and the excess portion of the film is removed after the support members are joined. Alternatively, a suitable length of the film is wrapped around the porous tube, which is then nested in the two support members for subsequent joining. In order to prevent spillage of the release agent from the ends of the applicator in its longitudinal direction, the two extremes ends of a sheet of the polymer film in its longitudinal direction are inserted between the mating surfaces of the support members, or if the film is wound around the porous tube, they may be sealed together before or simultaneously with the joining of the support members.

BRIEF DESCRIPTION OF THE DRAWINGS

FIGS. 8 and 9 are graphs showing the results of the experiment using the apparatus of FIG. 7, wherein FIG. 8 depicts results corresponding to the case of a porous tube having no air inlets and FIG. 9 depicts results corresponding to the case of a porous tube having air inlets in accordance with the present invention;

DESCRIPTION OF THE PREFERRED EMBODIMENTS

The present invention will hereafter be described in detail with reference to the accompanying drawings.

Figure 1A:
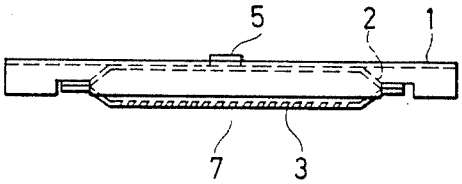
FIG. 1A (PRIOR ART)
FIG. 1A is a front view of an embodiment of a release agent applicator developed previously by one of the present inventors.
Figure 1B:
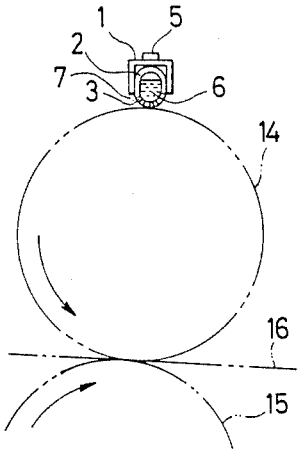
FIG. 1B (PRIOR ART)
FIG. 1B is a cross-sectional view of the release agent applicator of FIG. 1A.
Figure 2:
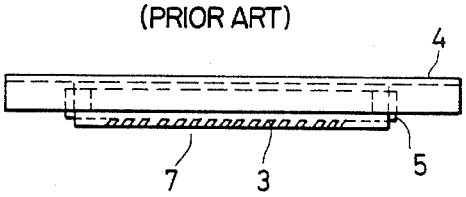
FIG. 2 (PRIOR ART)
FIG. 2 is a front view of another embodiment of the release agent applicator of FIG. 1A.
Figure 3A:
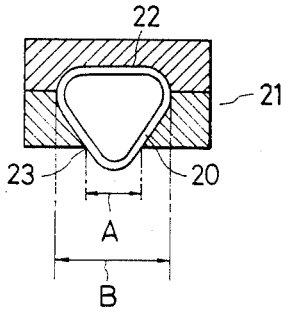
FIG. 3A is a cross-sectional view of a release agent applicator constructed in accordance with the present invention.
Figure 3B:
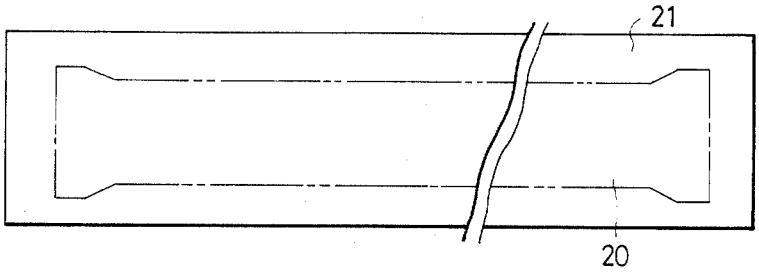
FIG. 3B is a longitudinal plan view of the release agent applicator of FIG. 3A.
Figure 4:
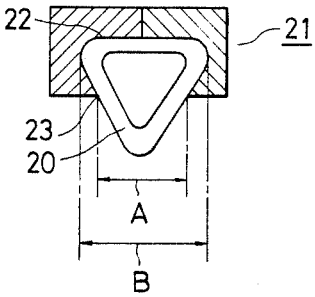
FIG. 4 is a cross-sectional view of another embodiment of a release agent applicator of the present invention.

FIGS. 3A, 3B and 4 show a first embodiment of the release agent applicator of the present invention. In these figures, reference numeral 20 indicates a porous polethylene tetrafluoride resin tube which is produced by extruding a polyethylene tetrafluoride resin mix containing a liquid lubricant into a tubular form, drawing the tube and sintering the same. Examples of this tube are shown in Japanese Patent Publication No. 13560/67 and Japanese Patent Application No. 155226/75 and have the following features: fine pores of a uniformly controlled size, preferably in the range of 0.1 to 10 μm; a porosity of 50 to 85%; an outside diameter of 5 to 50 mm; and a wall thickness of 0.1 to 5 mm. A commercial product having these dimensions is available from Sumitomo Electric Industries, Ltd. of Japan under the trade name "Porefuron TM".

Reference numeral 21 designates a support of a divided type. The support 21 may be divided into top and bottom sections as shown in FIG. 3A, or into right- and left-hand sections as shown in FIG. 4. The support 21 has a cavity 22 for accommodating the porous tube 20, whose maximum width B is greater than the width A of an opening 23 from which part of the porous tube projects to provide an outlet for the release agent ($A<B$).

According to the arrangement described above, when the two support members are joined, for example by fusion, the pores in the area of the porous tube other than that which projects from the opening are closed by contact with the support members, which also serve as a support for the porous tube.

Figure 5A:
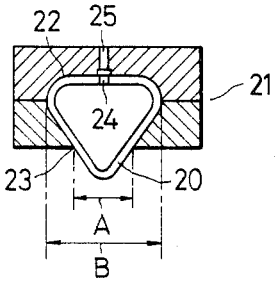
FIG. 5A is a cross-sectional view of still another embodiment of a release agent applicator of the invention.
Figure 5B:
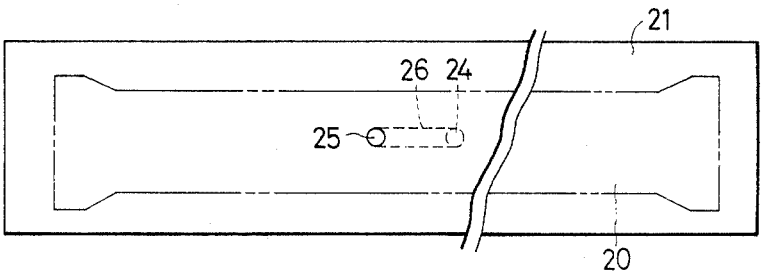
FIG. 5B is a longitudinal plan view of the applicator of FIG. 5A.
Figure 6:
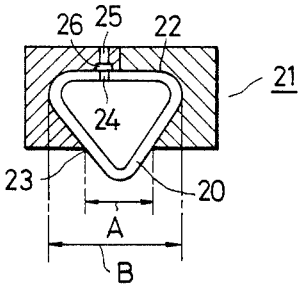
FIG. 6 is a cross-sectional view of yet another embodiment of a release agent applicator of the present invention.

FIGS. 5A, 5B and 6 show another embodiment of a release agent applicator of the present invention. In FIGS. 5A, 5B and 6, reference numeral 20 again indicates a porous polyethylene tetrafluoride resin tube which is produced by extruding a polyethylene tetrafluoride resin mix containing a liquid lubricant into a tubular form, drawing the tube and sintering the same as described above. Also as in the previously described embodiment, numeral 21 designates a support of a divided type, divided into top and bottom sections as shown in FIG. 5A or into right and left sections as shown in FIG. 6. The support 21 has a cavity 22 for accommodating the porous tube 20, whose maximum width b is greater than the width A of the opening 23 from which part of the porous tube projects to provide an outlet for the release agent ($A<B$).

As shown in FIGS. 5A, 5B and 6, the porous tube 20 and support 21 are respectively provided with air inlets 24 and 25 having a larger diameter (about 2 to 3 mmϕ) than that of the pores in the porous tube. Preferably, the two large-diameter air inlets are staggered from each other, more preferably, staggered in the longitudinal direction. In this case, the air inlet 25 in the support is connected to the air inlet 24 in the porous tube by a groove 25 of a width of, for instance 3 to 4 mm, formed in the support 21.

According to the embodiment, of FIGS 5A and 6, air is introduced into the interior of the porous tube through the large-diameter air inlets. Therefore, as seen from the experimental data shown graphically in FIG. 9, the amount of release agent applied will be very uniform over time. If the large-diameter air inlet in the porous tube is staggered in position with respect to the inlet in the support, the groove in the support in the area between each air inlet provides a vent for the release agent that may leak from the tube due to thermal expansion occurring when the applicator is installed on the fixing roll. The agent will return to the tube as guided by the groove and will not spill out of the applicator.

Figure 7:
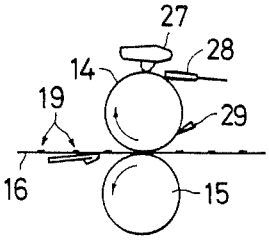
FIG. 7 is a schematic view of an apparatus used in an experiment conducted to test the present invention.
Figure 8:
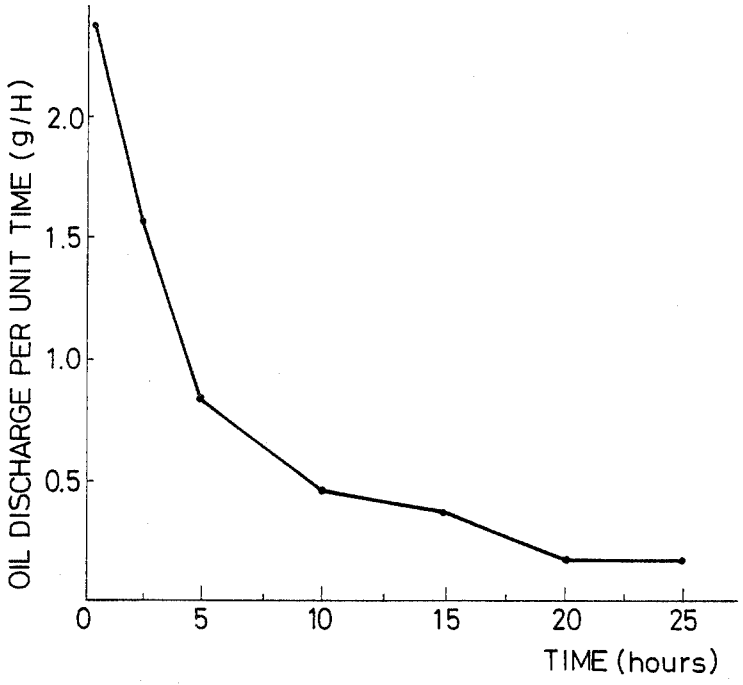
Figure 9:
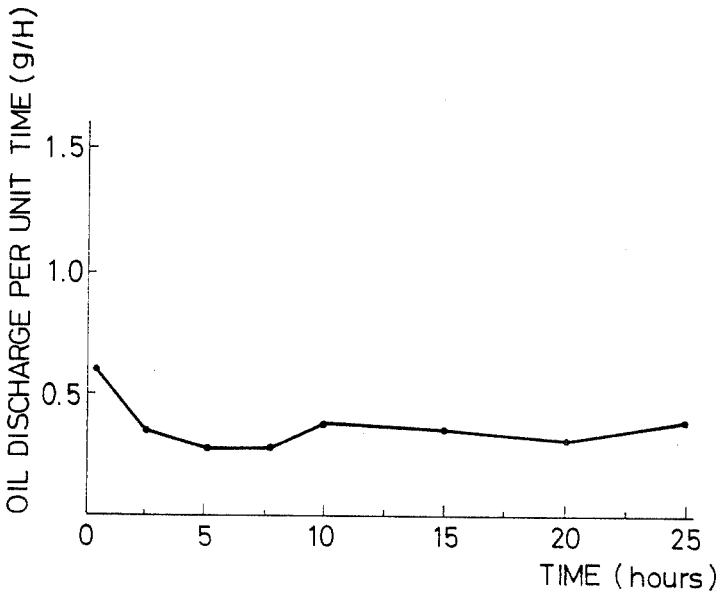

Experimental data obtained with the applicator of the present invention is shown with reference to FIGS. 7, 8 and 9. Two "Porefuron TM" tubes manufactured by Sumitomo Elecric Industries, Ltd. were filled with silicone oil of 30,000 c.s. The profiles of oil coatings obtained with a tube having no air inlets and a tube having air inlets are shown in FIGS. 8 and 9, respectively. The amount of oil discharged was measured in terms of the change in the weight of the applicator installed on a fixing roll of the type shown in FIG. 7. In FIG. 7, reference numeral 27 indicates an oil applicator, 28 a blade, 29 a scraper, 14 the fixing roller (heated to 180° C.), 15 a rubber pressure roller, 16 copy paper, and 19 toner particles.

As shown in FIG. 8, when the tube had no air inlets, an excessive amount of oil was discharged in the initial period of application due to an increased internal pressure resulting from the oil expansion, and as time went by, the decrease in pressure in the tube caused a gradual decrease in the amount of oil discharged.

As shown in FIG. 9, when the tube had air inlets, the oil discharged was somewhat great in the initial perioid, but it soon reached a steady level.

Figure 10:
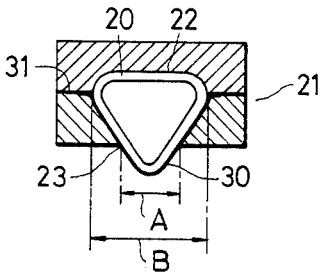
FIG. 10 is a cross-sectional view of yet another embodiment of a release agent applicator of the invention.
Figure 11:
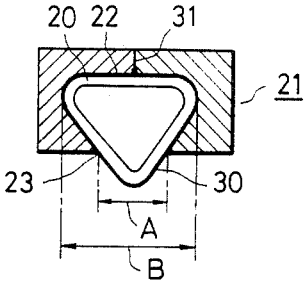
FIG. 11 shows a further embodiment of a release agent applicator of the invention.

Referring now to FIGS. 10 and 11, in accordance with another embodiment of the present invention, the outer surface of that part of the porous tube which projects from the opening 23 in the support, or the area through which the release agent is to ooze out, is covered in the middle portion thereof in the widthwise direction with a film 30 of a polymer having a low melting point. The ends of the middle portion are inserted between the walls of the cavity 22 and the porous tube 20, while the two extreme ends of the film 30 are inserted between the mating surfaces 31 of the two members of the support 21 so as to provide a packing portion.

The melting point of the polymer film may be such that the film melts when the fixing roll is heated to the operating temperature of the copying machine (usually 160° to 200° C.).

According to this embodiment of the present invention described above, since the outlet for the release agent is covered with the polymer film, no spillage of the agent will occur before use of the applicator, and during its use, the film is automatically removed by being melted away due to the heating of the fixing roll. Furthermore, the polymer film can be attached to the porous tube simultaneously with the installation of the latter on the support.

As described above, the present invention provides a release agent applicator which is very simple to construct by simply joining the two support members. In so doing, a support for the porous tube is formed, and at the same time, the pores in the area of the porous tube other than that through which oozes the release agent are closed by contact with the support memebers.

As already mentioned, the time of filling the porous tube with the release agent is not critical for the purpose of the present invention. The tube may be filled with the release agent before the tube is acommodated in the support, or alternatively, the release agent may be introduced into the tube through an inlet after the support members are joined to accommodate the tube. The pre-installation filling case is preferred for providing a disposable applicator.

We claim:

1. A release agent applicator for a copying machine comprising: a divided-type support having two members joined together for forming a cavity inside the support and for forming a longitudinally extending opening whose width is smaller than the maximum width of the cavity formed inside said support; a porous polyethylene tetrafluoride resin tube, the major portion of which is acommodated in the cavity and the remaining portion of which projects from said opening to provide a release agent outlet, the pores in said major portion of said tube other than said remaining portion projecting from said opening being closed by contact between said porous tube and abutting walls of said cavity in said support; and air inlets provided in said porous tube and said support and having diameters greater than diameters of the pores formed in said porous tube to introduce air into the interior of said porous tube.

2. The release agent applicator according to claim 1, wherein said porous polyethylene tetrafluoride resin tube is filled with release agent before said tube is accommodated in said support.

3. The release agent applicator according to claim 1, wherein said porous polyethylene tetrafluoride resin tube is filled with release agent after said tube is accommodated in said support.

4. The release agent applicator according to claim 1, wherein said air inlets are provided at staggered positions in said porous tube and said support.

5. The release agent applicator according to claim 4, wherein said support is provided with a groove connecting said air inlet in said support and said air inlet in said porous tube.

6. The release agent applicator according to claim 4, wherein said air inlet in said support is staggered in the longitudinal direction of said support with respect to said air inlet in said porous tube.

7. The release agent applicator according to claim 1, wherein the outer surface of said remaining portion of said tube projecting from said opening in said support is covered with a film of a polymer having a low melting point, opposed edge portions of said film in a widthwise direction being inserted between said abutting walls of said cavity and said porous tube.

8. The release agent applicator according to claim 7, wherein opposed extreme ends of said polymer film in a widthwise direction are inserted between mating surfaces of said support members.

* * * * *

UNITED STATES PATENT AND TRADEMARK OFFICE

CERTIFICATE OF CORRECTION

PATENT NO. : 4,580,521

DATED : April 8, 1986

INVENTOR(S) : Ogino et al.

It is certified that error appears in the above-identified patent and that said Letters Patent is hereby corrected as shown below:

Column 1, line 37, "relese" s/b --release--;

line 49, "partus" s/b --paratus--.

Column 3, line 51, "polethylene" s/b --polyethylene--.

Column 4, line 24, "b" s/b --B--;

line 38, "embodiment" s/b --embodiments--.

Column 5, line 4, "discharged" s/b --discharge--;

line 4, "perioid," s/b --period,--;

line 39, "memebers." s/b --members.--.

Signed and Sealed this

*Eighth* Day of *July 1986*

[SEAL]

*Attest:*

DONALD J. QUIGG

*Attesting Officer*

*Commissioner of Patents and Trademarks*